US006293217B1

(12) United States Patent
Savage et al.

(10) Patent No.: US 6,293,217 B1
(45) Date of Patent: Sep. 25, 2001

(54) FLEXIBLE VESSELS FOR TRANSPORTING FLUENT CARGOES

(75) Inventors: Nicholas Macewan Savage, Chobham; Christopher David Wyndham Savage, Surry, both of (GB)

(73) Assignee: Aquarius Holdings Limited (GB)

( * ) Notice: Subject to any disclaimer, the term of this patent is extended or adjusted under 35 U.S.C. 154(b) by 0 days.

(21) Appl. No.: 08/973,871

(22) PCT Filed: Jul. 8, 1996

(86) PCT No.: PCT/GB96/01634

§ 371 Date: May 3, 1998

§ 102(e) Date: May 3, 1998

(87) PCT Pub. No.: WO97/02980

PCT Pub. Date: Jan. 30, 1997

(30) Foreign Application Priority Data

Jul. 7, 1995 (DE) ..... 9513911

(51) Int. Cl.[7] ..... B63B 25/08
(52) U.S. Cl. ..... 114/256; 114/74 T
(58) Field of Search ..... 220/560; 114/74 R, 114/74 T, 256, 77 R, 242

(56) References Cited

U.S. PATENT DOCUMENTS

| | | | | |
|---|---|---|---|---|
| 2,391,926 | * | 1/1946 | Scott | 114/74 T |
| 2,682,751 | | 7/1954 | Bock . | |
| 3,067,712 | * | 12/1962 | Doerpinghaus | 114/74 T |
| 3,150,627 | * | 9/1964 | Stewart et al. | 114/74 T |
| 3,282,361 | * | 11/1966 | Mackie | 114/74 T |
| 3,289,721 | | 12/1966 | Benson . | |
| 3,983,830 | | 10/1976 | Morgan . | |
| 5,413,065 | | 5/1995 | Spragg et al. . | |

FOREIGN PATENT DOCUMENTS

| | | | | |
|---|---|---|---|---|
| 221702 | * | 3/1958 | (AU) | 114/74 T |
| 512 102 | * | 10/1930 | (DE) | 114/242 |
| 2210180 | | 6/1974 | (FR) . | |
| 2377931 | | 8/1978 | (FR) . | |
| 846359 | | 8/1960 | (GB) . | |
| 1440800 | | 6/1976 | (GB) . | |
| 2181996 | | 5/1987 | (GB) . | |
| 173 496 | * | 11/1960 | (SE) | 114/74 T |

* cited by examiner

*Primary Examiner*—Sherman Basinger
(74) *Attorney, Agent, or Firm*—Miles & Stockbridge P.C.; John C. Kerins

(57) ABSTRACT

An apparatus and a method for transporting fluent cargoes through liquid are provided, the apparatus including one or more units arranged in substantially linear alignment, in which at least one of the units includes two or more non-internally reinforced containers close-coupled in a side-by-side manner.

19 Claims, 1 Drawing Sheet

FLEXIBLE VESSELS FOR TRANSPORTING FLUENT CARGOES

BACKGROUND OF THE INVENTION

1. Field of the Invention

The present invention relates to flexible vessels for transporting fluent cargoes through liquid.

2. Description of the Related Art

Vessels of this nature are known and can take the form of closed flexible tubular or envelope structures, generally of a synthetic rubberised fabric. Such vessels are used to transport fluent cargoes having a specific gravity less than that of the liquid in which they are being transported. Ordinarily, the fluent cargo has a specific gravity less than that of seawater. When laden, the vessel is virtually completely submerged and buoyancy is supplied by the cargo. To move such laden vessels, they are towed from one end by for example a tug boat.

One such vessel is known from GB-A-0 883 813 wherein the vessel is made in a tubular shape with a streamlined bow. The vessel is towed by way of a rope that is attached to the bow of the vessel.

Such laden vessels have intrinsic stability problems, particularly where the vessel is used in anything other than calm seawater conditions. For example, waves can set up undesirable oscillations in the fluent cargo. The cargo will in this regard have a natural frequency which if coincidental with an applied wave frequency, can lead to resonance. The resulting magnification of the oscillation of the fluent cargo is clearly to be avoided otherwise damage and rupture of the vessel can occur. In addition, the exterior profile of the vessel can be distorted from its most streamlined and drag-free configuration such that the vessel requires an increased towing force to maintain speed.

In this connection, measures have been proposed for reducing the effects of resonance within the vessel itself, for example by providing internal stabilisers in the form of fabric diaphragms within the vessel interior, such diaphragms having holes or perforations to control the flow of cargo. Also, a vibration absorber within the vessel has been proposed comprising an inner tube of fabric so filled as to resonate at the forcing frequency of the waves. However, such measures have only a limited effect and introduce other problems.

Another problem arises in that such laden vessels exhibit yaw. This is where the vessel moves off the preferred towing direction in an uncontrolled fashion so that the vessel can become extremely difficult to control.

In this connection, it has been common practice to mount a stabiliser in the form of a specially configured end, skirt or drogue at the rear end of the vessel to reduce the tendency of the vessel to yaw undesirably. From GB-A-0 846 359, for example, in order to improve stability, the containers of this document are provided with large fins to attempt to prevent yaw and roll. However, these in practice do not wholly solve the problem of yaw and in any case the extra drag caused thereby significantly increases the towing forces required to move the vessel. Indeed, such forces can be doubled. Clearly this has a disadvantageous effect on fuel efficiency of the towing means and thus overall running costs. In addition, this has proved a cap on the maximum practical cargo load that can be transported, typically in the range of 1,000 to 3,000 $m^2$. Attempts at transporting higher loads have failed.

Another problem arises in that such laden vessels exhibit instability in twist, due to shear forces created by breaking waves, which leads to capsize in bow and quarter seas in particular.

It is thus an object of the present invention to provide an apparatus for transporting fluent cargoes which has an improved stability without significant sacrifices to streamlining efficiency or vessel size.

SUMMARY OF THE INVENTION

According to the present invention there is provided apparatus for transporting fluent cargo through liquid comprising one or more units arranged substantially in linear alignment, wherein at least one said unit comprises two or more flexible containers close coupled side by side.

The provision of two such containers side by side creates a highly stable arrangement which in particular provides enhanced bi-lateral stability and directional stability, reduces damaging oscillation and enhances torsional stability. Thus, internal or external stabilisers are not required. This reduces drag and therefore the required towing forces which enables larger cargoes to be transported than hitherto known or alternatively enables a reduction in the thickness of the material comprising the flexible container resulting in reduced vessel construction costs. In addition, the arrangement assists in distributing structural forces applied to the apparatus, namely those applied by towing, control, mooring and environmental forces.

In particular, in tests it has been found that if the apparatus of the present invention is pulled in the direction of said linear alignment, the apparatus follows the pulling direction with substantially no yaw and presents a very stabile structure. Indeed, in tank tests with flowing water, it has been found that when the apparatus is connected to a line in the flowing water, and released such that the line initially makes an angle to the direction of flow, the apparatus moves to make the line parallel to the flow without overshoot. Accordingly, the apparatus of the present invention follows the towing direction despite the effects of external environmental influences.

The interaction between the various forces resulting from the towing, the external liquid movements and the cargo movements is highly complex and a theoretical basis for the behaviour of the present invention has not been established at the present time.

In preferred embodiments, in use of the apparatus, adjacent facing sides of respective containers of said at least one unit are substantially parallel along at least part of their length. In this manner, the stability of the apparatus can be enhanced.

Preferably, no two consecutive linearly aligned units comprise a single flexible container. In this way, the stabilising effect of the flexible container arrangement is not prejudiced by destabilising effects that may be caused by single flexible container units adjacently linearly aligned.

In preferred embodiments, each container has angled, preferably apexed, front and rear end sections. The containers may be parallel sided and may be diamond-shaped or hexagonal. In this manner, the front and rear end sections of consecutive units can be compactly and securely joined together.

The containers are substantially or completely submerged in use. The containers are conveniently connected at their broadest extent. This assists towards providing an enhanced stable arrangement.

In preferred embodiments, the apparatus comprises alternating sequential units of one and two containers. Conveniently, the apparatus comprises three units of one container and two units of two containers.

Certain embodiments of the present invention will now be described by way of example and with reference to the accompanying drawings, in which:

DETAILED DESCRIPTION OF THE PREFERRED EMBODIMENTS

Figure 1:
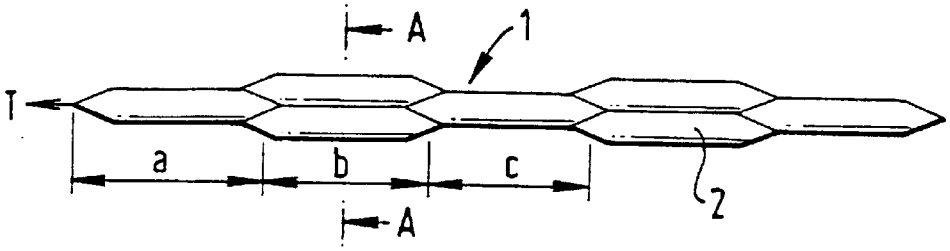
FIG. 1 is a plan view from above of a flexible vessel apparatus of a first embodiment of the present invention.

FIG. 1 shows in plan view from above a flexible vessel apparatus 1, used for transporting fluent cargo, for example, vegetable oil, fruit juice or fresh water, through liquid. The apparatus includes a number of units a, b, c etc. connected in sequential linear alignment. Each unit comprises either a single container or pod 2 or two such containers or pods. In the units having two containers, they are connected so that they are positioned side by side or adjacent with their longitudinal axes parallel.

Figure 2:
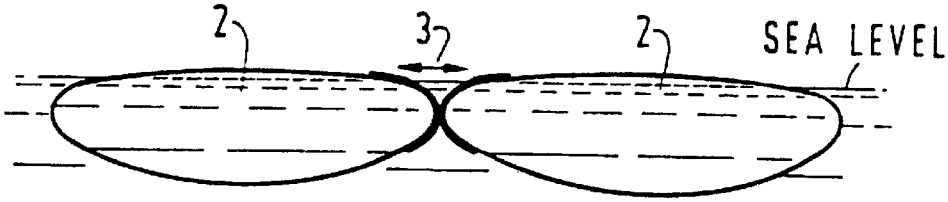
FIG. 2 is a cross-sectional view taken through the line A—A of FIG. 1.

As shown in FIG. 2, the containers are close coupled. They may be connected at their broadest extents by rolling spring lashings 3. In this way, the top surfaces of the containers can be fixed rigidly or elastically so that they are close-rigged together by tangential springs. Close rigging requires that all adjacent facing edges of the containers are connected.

Figure 4:
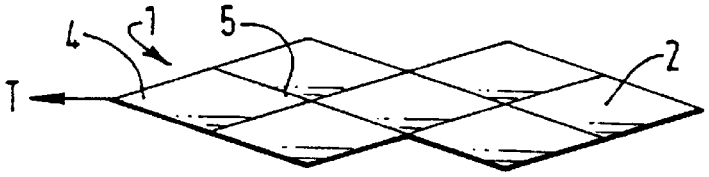

As shown particularly in FIG. 4, the containers may be connected in nesting formations, this being assisted by each container being of a symmetrical configuration in plan view. By nesting the containers, increased stability may be achieved along with increased cargo transportation.

Figure 5:
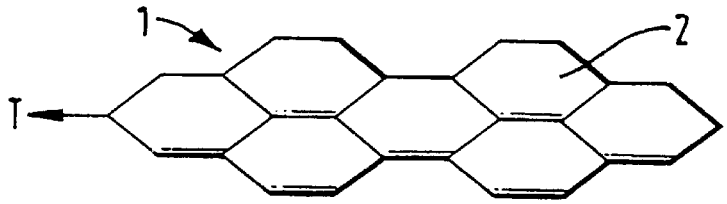

In this regard, whilst any suitable shape of container may be used, each is preferably parallel-sided with apexed bow and stern sections 4, 5. The containers may be diamond shaped or hexagonal shaped as shown in FIG. 5.

Figure 3:
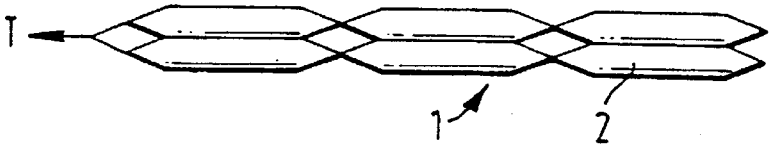
FIGS. 3 to 6 show plan views from above of alternative embodiments of the present invention.

Parallel-sided containers may be rigged in diamond formation as shown in FIG. 4 or in two or more parallel lines as shown in FIG. 3. Diamond-shaped and hexagonal containers are rigged diamond formation to achieve the advantages of close rigging.

The exterior opposing or facing sides of adjacent respective containers run generally parallel along their length. In this manner, parallel sided channels are set up between adjacent containers through which, during use, liquid, namely seawater can flow.

Each container is made as a closed flexible envelope from panels of fabric welded together to be form stable under hydrostatic conditions. The fabric has a thickness in the range of 1.5 to 3.5 mm and the circumference of the container is preferably in the range 60 to 180 m. In use, the container is filled to approximately 50% to 70% capacity, although other capacities can be used.

The bow and stern are provided with piped orifices (not shown) for loading and discharge purposes and bridles (not shown) may be provided for towing and mooring the vessel apparatus and can be integral with the structural design of the vessel.

Flexible tubes of fabric (air sponsons) can be provided which are inflatable to increase the torsional stability of the vessel apparatus should this be required. The vessel may be provided with further flexible tubes of fabric (water sponsons) which when filled with fluent cargo or sea water create stiffened structures which assist to reinforce the apparatus against hydro-dynamic pressures. The flexible containers have stiffened flexible anchorage points at the bow and stern and at intermediate positions for the purposes of inter-connection.

For towing purposes, the containers are rigged directly to a tender-barge or an integral buoyancy device which is towed by a tug according to normal practices. As shown in FIG. 3, where the apparatus comprises a first front unit having two or more containers, such containers are connected directly to a common towing point. This arrangement is possible because of the self-stabilising nature of the apparatus.

The containers may be provided with buoyancy means to provide support when the container is empty or partially empty.

It will be understood that the embodiments illustrated show an application of the invention in one form only for the purposes of illustration. In practice the invention may be applied to many different configurations, the detailed embodiments being straightforward for those skilled in the art to implement.

Whilst the present invention has been described with reference to transporting cargoes through sea water, it will be apparent that the invention can be adapted to transport cargoes through fresh water. The flexible container of the present invention preferably has a generally compressed circular cross-sectional shape which is determined by the hydrostatic pressures.

Figure 6:
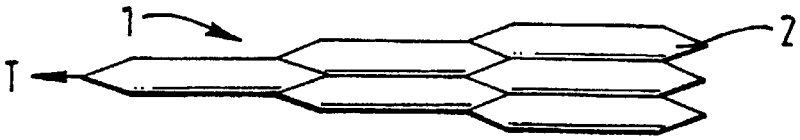

It will be apparent that whilst multiple arrangements of units are shown in the drawings, the apparatus of the present invention may take the form of just two flexible containers connected so that they are positioned side by side or adjacent with their longitudinal axes parallel in combinations such as 1:2, 1:2:3 etc as shown in FIG. 6 or progressive combinations of 1:2:1:2 etc or 1:2:3:2:1 units.

What is claimed is:

1. A method of transporting fluent cargo through liquid in flexible containers wherein the method comprises the steps of:

a) arranging one or more units substantially in linear alignment, each of said one or more units comprising two or more flexible containers, said flexible containers having no structural reinforcement which dictates a fixed or rigid shape for the containers while in use;

b) close coupling said flexible containers of each said unit side by side;

c) transporting said containers in said liquid, said containers being substantially submerged in said liquid in use so that a top surface of each container lies at the liquid's surface.

2. A method according to claim 1, wherein adjacent facing sides of respective containers of said at least one unit are substantially parallel along at least part of their length.

3. A method according to claim 1, wherein no two consecutive linearly aligned units comprise a single flexible container.

4. A method according to claim 1, wherein each container has angled, front and rear end sections.

5. A method according to claim 1, wherein each container is parallel sided.

6. A method according to claim 1, wherein the container is diamond-shaped or hexagonal.

7. A method according to claim 1, wherein the containers are connected at their broadest extent.

8. A method according to claim 1, further comprising arranging said one or more units comprising two or more containers in linear alternating fashion with single non-internally reinforced flexible containers.

9. A method according to claim 1, wherein the apparatus comprises three units of one container and two units of two containers.

10. Apparatus for transporting fluent cargo through liquid, comprising at least one unit having a plurality of flexible containers close-coupled side-by-side; said flexible containers having no structural reinforcement which dictates a fixed or rigid shape for the containers while in use; said flexible containers further being so constructed and arranged to, when laden with cargo, be substantially submerged in a liquid through which said cargo is to be transported, wherein a top surface of each of said plurality of containers lies at a surface of said liquid.

11. Apparatus as recited in claim 10, comprising a plurality of units in substantially linear alignment, wherein each of said plurality of units comprises a plurality of flexible containers close coupled side-by-side.

12. Apparatus as recited in claim 11, wherein no two consecutive linearly aligned units comprise a single flexible container.

13. Apparatus as recited in claim 11, wherein the apparatus comprises alternating said units which comprise a plurality of flexible containers with single non-internally reinforced containers, in a linear arrangement.

14. Apparatus as recited in claim 11, wherein the apparatus comprises three units of one container and two units of two containers.

15. Apparatus as recited in claim 10, wherein adjacent facing sides of respective containers of said at least one unit are substantially parallel along at least part of their length.

16. Apparatus as recited in claim 15, wherein the containers positioned side-by-side are connected at their broadest extent.

17. Apparatus as recited in claim 10, wherein each container has angled, front and rear end sections.

18. Apparatus as recited in claim 17, wherein each container is diamond-shaped or hexagonal.

19. Apparatus as recited in claim 10, wherein each container is parallel sided.

* * * * *

UNITED STATES PATENT AND TRADEMARK OFFICE

CERTIFICATE OF CORRECTION

PATENT NO. : 6,293,217 B1 
DATED : September 25, 2001
INVENTOR(S) : Nicholas Macewan Savage and Christopher David Wyndham Savage It is certified that error appears in the above-identified patent and that said Letters Patent is hereby corrected as shown below:

Title page,
Item [75], Address for Christopher Savage should be -- W. Sussex --, not "Surry"

Item [86], §371(e) Date: change "May 3 1998" to -- May 3, 1999 --; and
§102(e) Date: change "May 3, 1998" to -- May 3, 1999 --

Signed and Sealed this

Twenty-fourth Day of December, 2002

JAMES E. ROGAN
*Director of the United States Patent and Trademark Office*